United States Patent [19]

Anikanov et al.

[11] 3,980,183

[45] Sept. 14, 1976

[54] DELIVERY AND COLLECTING ARRANGEMENT FOR ROTARY MACHINES FOR PRINTING BOOKS OR MAGAZINES

[76] Inventors: Nikolai Ivanovich Anikanov, Bolshaya Bronnaya ulitsa, 2/6, kv. 6; Leonid Pavlovich Grachev, ulitsa Lva Tolstogo, 7, kv. 32, both of Moscow; Grigory Iosifovich Zax, ulitsa Mechnikova, 14a, kv. 24, Kiev; Grigory Avramovich Radutsky, 16 Parkovaya ulitsa, 49, korpus 2, kv. 68, Moscow; Rafail Efimovich Kheifets, Brest-Litovksy prospekt, 162, kv. 30, Kiev, all of U.S.S.R.

[22] Filed: July 29, 1975

[21] Appl. No.: 600,123

Related U.S. Application Data

[63] Continuation of Ser. No. 509,962, Sept. 27, 1974, abandoned.

[30] Foreign Application Priority Data

Dec. 21, 1973 U.S.S.R. ..... 1975409

[52] U.S. Cl. ..... 214/6 M; 93/93 D; 271/64; 271/80

[51] Int. Cl.[2] ..... B65G 57/03

[58] Field of Search ..... 214/6 DK, 6 H, 6 M, 214/6.5; 93/93 D, 93 DP; 271/64, 80; 270/58

[56] References Cited

UNITED STATES PATENTS

| | | | |
|---|---|---|---|
| 1,915,376 | 6/1933 | Moone | 93/93 DP |
| 2,109,050 | 2/1938 | Quick et al. | 271/64 X |
| 2,794,637 | 6/1957 | Rugg | 271/192 |
| 2,855,833 | 10/1958 | Rugg et al. | 93/93 DP |
| 3,488,693 | 1/1970 | Brinkmeier | 214/6.5 |

*Primary Examiner*—L. J. Paperner
*Attorney, Agent, or Firm*—Holman & Stern

[57] ABSTRACT

This invention relates to apparatus for printing books or magazines and may be the most efficiently used in the printing apparatus having the provision for the collection of booklets into stacks with subsequent compression thereof. The arrangement is provided with two spiders and receiving bins located thereunder for collecting stacks of booklets, each bin having a driven moveable or sinkable bottom for transferring the stacks to pallets of a discharge conveyor. Each of the bins is provided with a slot in one of the side walls thereof for feeding rigid boards therein to be placed over and beneath the stack being collected, respectively, there being provided a magazine for these boards having driven pushers for feeding the boards one-by-one into each of the bin.

5 Claims, 3 Drawing Figures

DELIVERY AND COLLECTING ARRANGEMENT FOR ROTARY MACHINES FOR PRINTING BOOKS OR MAGAZINES

This is a continuation of application Ser. No. 509,962 filed Sept. 27, 1974, now abandoned.

BACKGROUND OF THE INVENTION

This invention relates to the rotary printing machines, and more specifically to delivery and collecting apparatus for rotary machines for making books or magazines.

The present invention may be the most advantageously used in rotary printing machines for books or magazines with the provision for the collection of booklets into stacks with subsequent compression thereof.

At present, the roll rotary machines for printing books or magazines are provided with delivery and collecting apparatus receiving the printed and folded sheets in the form of booklets. This apparatus comprises a system of conveyors for collecting and moving the booklets, which are positioned vertically with the folded edge up, and mechanisms for dividing these booklets into a succession of stacks. In order to collect the booklets into stacks and keep them in the stacks, rigid boards are manually inserted in between these stacks, and the apparatus is provided with a vertically rotatable press located downstream of the conveyors for receiving the stacks separated by the boards and for subsequent rotation thereof at 90°, whereby the stacks are positioned vertically.

Such an arrangement ensures the reliable stacking of booklets, but it uses manual labor for inserting the rigid boards therebetween to collect the stack. In addition, the employment of a rotatable press and mechanism for collecting the booklets into stacks makes the arrangement more complicated and requires a larger production area.

The arrangement may be made simplier and more compact by using a delivery and collecting device comprising a folder and two spiders mounted under the folder, the printed and folded articles, such as booklets, being alternately fed to said spiders by means of a driven switch. A receiving bin is mounted under each of the spiders for collecting horizontally positioned booklets into vertical stacks, and each of the bins is provided with a driven moveable or sinkable bottom for transferring the resulting stack to a discharge conveyor.

While this arrangement dispenses with the employment of a rotatable press and mechanism for the separation of booklets into a succession of stacks, it is efficient in the rotary machines for printing newspapers only. This is due to the fact that when using such an arrangement in the machines for printing books or magazines, manual labor is still required for inserting rigid boards to collect a stack of booklets and to compress it. Furthermore, the discharge conveyor cannot ensure a reliable discharge of a relatively high stack occurring in collecting the parts of a book or magazine.

It is an object of the invention to provide a delivery and collecting apparatus for rotary machines for printing books or magazines which enables the mechanization of feeding the rigid boards used to collect parts of a book or magazine into stacks.

An important object of the invention is to provide a delivery and collecting apparatus which ensures the reliable discharge of relatively high stacks.

Still another object of the invention is to provide a delivery and collecting arrangement having a simple and compact construction.

These and other objects are accomplished due to the fact that in a delivery and collecting apparatus for a rotary machine for printing books or magazines comprising: a folder; two spiders mounted under the folder; the printed and folded articles being alternately fed to the spiders by means of a driven switch receiving bins for stacking said articles said bins being mounted in series, one after another, in the direction of the stack movement, each mounted under each of said spiders; and each bin having a driven sinkable bottom for transferring the resulting stack to a discharge conveyor. According to the invention, each of the bins is provided with a slot in one of the side walls thereof for feeding rigid boards therein, each board being placed over and beneath the stack being collected, and there being provided magazines for said boards having driven pushers for feeding the boards one-by-one into each of the bins, and the drive of each pusher is coupled to the drive of said switch in such a manner that during the collection of a stack, the boards are fed into each bin one-by-one at time intervals corresponding to the filling time of the bin, and the discharge conveyor is provided with pallets for receiving the resulting stack from each of said bottoms, each pallet comprising a corrugated strip having uniformly spaced corrugations of rectangular shape.

This embodiment of the apparatus dispenses with manual labor due to the use of a magazine for rigid boards and a pusher for feeding the boards one-by-one, whereby the mechanical placing of said boards is ensured over and beneath the stack being collected, respectively.

In addition, the employment of the receiving pallets in the discharge conveyor, each comprising a corrugated strip, ensures the reliable discharge of the stacks.

In order to simplify the structure of the arrangement, each pusher for rigid boards preferably comprises a slide bar rigidly connected to a toothed rack meshing with a pinion for reciprocating movement so that a single board is ejected from said magazines by the slide bar during one stroke of the toothed rack. In order to ensure the stability of the stack being collected, the bottom of the second bin is connected to the rear wall thereof by means of telescopic tubes so that the tubes of a greater diameter are located in said wall, and the ends of the tubes of a smaller diameter are fixed to the bottom.

These telescopic tubes support the stack being collected during the lowering of the bottom of this bin thus maintaining the stability of the stack.

According to the invention, the first bin is further provided with a stop for the stack being collected, said stop being fixed to the rear wall of this bin and intended for maintaining the stack during the lowering of the bottom of this bin.

In order to ensure the reliable discharge of a comparatively high stack, such as of the order of 50 cm, two superposed closed-loop horizontal conveyors are preferably provided at either side of the discharge conveyor, the conveyors having plates supporting the stack, the height of the plates being at least equal to the height of the stack being discharged.

The invention will be better understood from the following detailed description of a specific embodiment thereof with reference to the accompanying drawings, in which:

DESCRIPTION OF THE INVENTION

Figure 1:
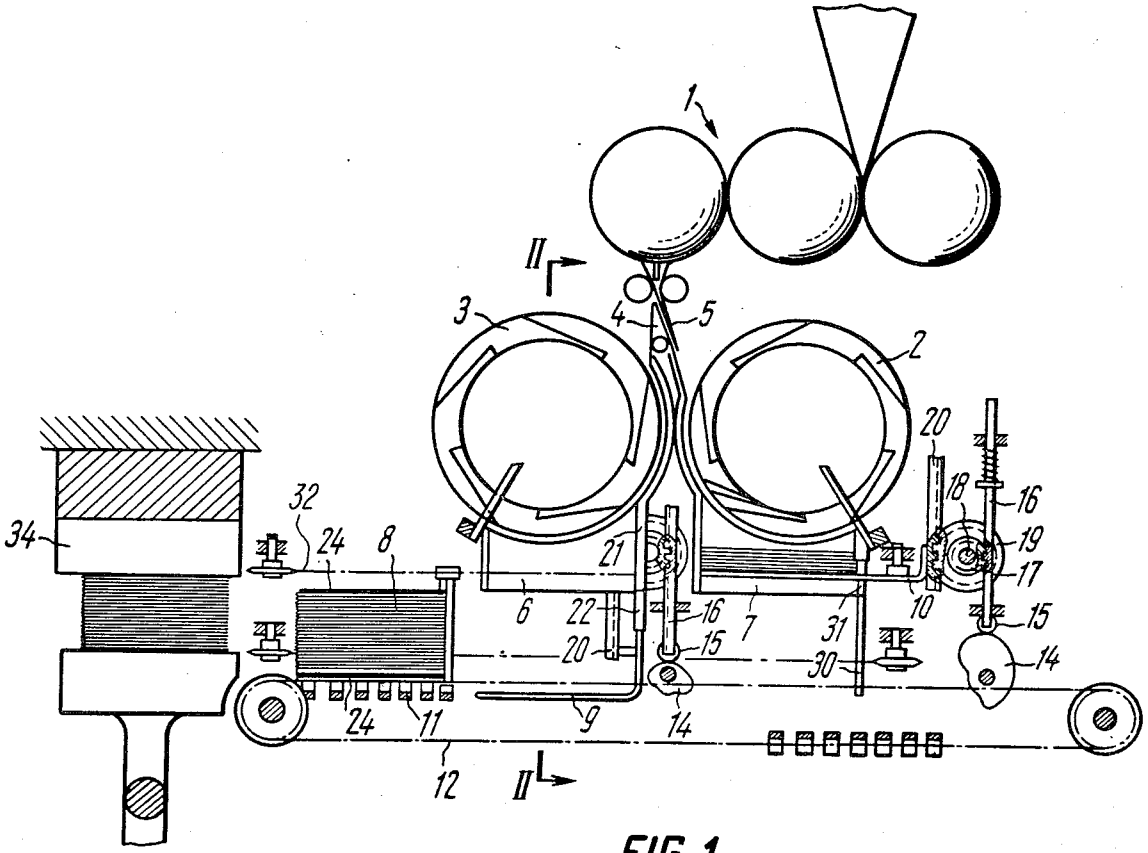
FIG. 1 shows a general side elevation view of a delivery and collecting arrangement for rotary machines for printing books or magazines.
Figure 2:
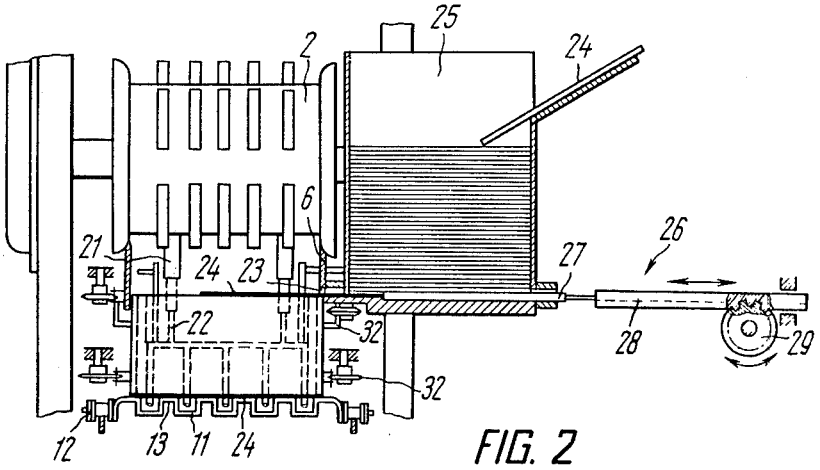
FIG. 2 is a sectional view taken along the line II-II in FIG. 1.

The delivery and collecting arrangement comprises a folder 1 (FIG. 1) and two spiders 2 and 3 mounted thereunder. Book or magazine booklets are alternately fed from the folder 1 by means of a driven switch 4 into these spiders. A receiving bin 6 or 7 for collecting the booklets 5 into stacks 8 is mounted under each spider. Each bin is provided with a sinkable driven bottom 9 or 10, respectively, for transferring the resulting stack to receiving pallets 11 of a discharge conveyor 12. Each bottom 9 or 10 comprises a fork, and each of the pallets 11 comprises a corrugated strip with uniformly spaced transversal corrugations 13 (FIG. 2) of the rectangular shape, the depressions between the corrugations receiving the teeth of the forks of the bottoms 9 or 10 during the transfer of the stack 8 to the pallets 11.

The drive of each of the bottoms 9 or 10 comprises a shaped cam 14 (FIG. 1) cooperating with a roller 15 fixed to a toothed rack 16. This rack meshes with a pinion 17 mounted on an axle 18 having another pinion 19. The pinion 19 cooperates with a rack 20 fixed to the bottom 9 or 10.

The bottom 9 of the bin 6 is connected to its rear wall 21 by means of telescopically connected tubes 22 so that the tubes of a greater diameter are located in the wall 21, and the ends of the tubes of a smaller diameter are secured to the bottom 9.

The drives of the bottoms 9 and 10 are so constructed that during the lifting of one of the bottoms, the other one is lowered.

Each of the bins 6 or 7 is provided with a slot 23 (FIG. 2) in one of the side walls for feeding rigid boards 24 therein which are to be placed over and beneath the stack 8 being collected, respectively. These boards are stored in magazines 25 having driven pushers 26 for feeding the boards 24 one-by-one into each of the bins 6 or 7 through the slot 23. The drive of each pusher 26 is coupled to the drive of the switch 4 in such a manner that during the collection of a stack in one of the bins 6 or 7 the boards 24 are fed into each bin one-by-one at time intervals corresponding to the filling time of this bin.

Each pusher 26 comprises a slide bar 27 rigidly connected to a reciprocating toothed rack 28 cooperating with a driving pinion 29. As a result of this reciprocation, the slide bar 27 ejects a single board 24 from the respective magazine 25 into the respective bin 6 or 7 during one stroke of the rack 28.

In order to support the stack on the bottom 10 during the lowering thereof (FIG. 1) in the bin 7, this bin is provided with a stop 30 fixed to the rear wall 31 thereof.

Figure 3:
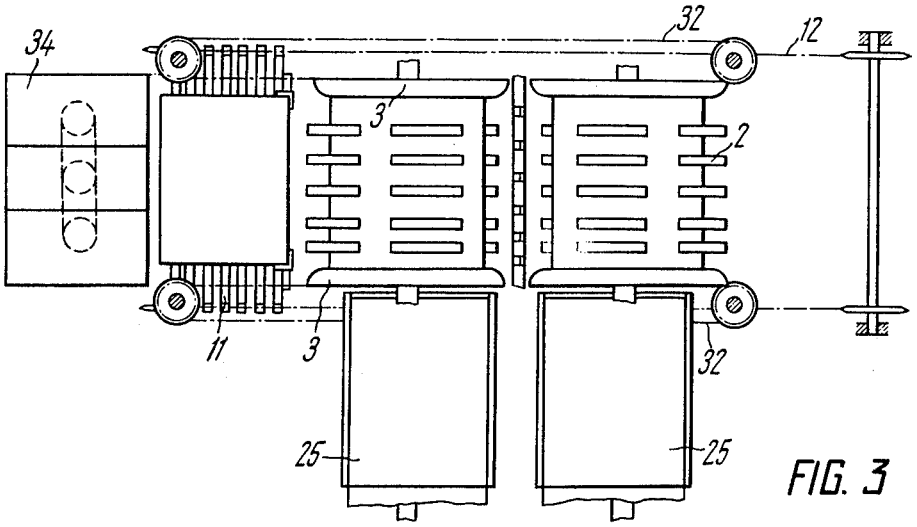
FIG. 3 is a plan view of the machine shown in FIG. 1 without a folder.

In order to ensure the reliable discharge of the comparatively high stack 8, such as of the order of 50 cm, two superposed closed-loop horizontal conveyors 32 (FIG. 3) are disposed at either side of the discharge conveyor 12, said conveyors having plates (not shown) supporting the stacks (FIG. 1), the height of the plates being at least equal to the height of the stack being discharged.

The stack being discharged is fed into a press 34 wherein it is compressed and bundled. The press may be of any known type used in the book and magazine printing.

The arrangement operates as follows:

Prior to the feeding of the booklets 5, e.g. into the bin 6, the drive of the pinion 29 is energized so that the slide bar 27 ejects one rigid board 24 to the bottom 9 of this bin from the magazine 25. Then the switch 4 is actuated to feed the booklets 5 to the spider 3 which, in turn, feeds them into this bin. As the stack 8 is being formed, the bottom 9 is lowered, and the stack being formed is supported on the bottom by means of the telescopic tubes 22 which are extended during the lowering of this bottom. By the completion of the collection of the stack in the bin 6, when the bottom 10 of the bin 7 is near to its uppermost position, the respective slide bar 27 will feed a board into the bin 7. After the stack in the bin 6 has been collected, the switch 4 is actuated to feed the booklets into the bin 7, and the slide bar 27 corresponding to the bin 6 will feed the board 24 to place it over the resulting stack from the respective magazine 25. Subsequently, during a further lowering of the bottom 9 with the stack 8 collected in the bin 6 and located between the boards 24, this stack is transferred to the pallets 11 of the conveyor 12. This occurs due to the fact that the teeth of the fork of the bottom 9 are received in the depressions between the corrugations 13 of the pallets 11 so as to leave the stack on the discharge conveyor during the lifting of the bottom 9. Further, this stack supported by the plates 33 of the conveyors 32 is transported by the conveyor 12 to the press 34 to be compressed and bent by any appropriate method.

The collection of a stack in bin 7 and its subsequent feeding into the press takes place substantially as described above, with the only difference that the stack is supported during the collection by means of the stop 30, rather than by means of the telescopic tubes 22.

What is claimed is:

1. A delivery and collecting apparatus in rotary machines for making books comprising: a folder for shaping booklets to make books; two spiders mounted under said folder; a driven switch to direct said booklets after leaving the folder to one of said spiders; two receiving bins having driven movable bottoms for receiving the booklets leaving said spiders and for collecting them into stacks, said bins being located in series in the direction of stack movement so that each bin is located under each of said spiders; each of said bins being provided with a slot in one of the side walls thereof for feeding rigid boards therein to be placed over and beneath the stack being collected, respectively; a container for the rigid boards disposed adjacent to each receiving bin; a driven pusher for said rigid boards located inside said container for feeding said boards one-by-one alternately into each of the bins; said drive of said pusher being coupled to the drive of said driven switch in such a manner that during the collection of said stack the rigid boards are fed one-by-one into each bin at time intervals corresponding to the filling time of the bin; a discharge conveyor mounted under said receiving bins, said discharge conveyor having pallets for receiving the resulting stack from each of said movable bottoms; and each of said pallets comprising a corrugated strip having uniformly spaced corrugations of rectangular shape.

2. The apparatus as claimed in claim 1, wherein each of said pushers comprises a slide bar rigidly connected to a toothed rack cooperating with a pinion for its reciprocation, whereby the slide bar ejects a single rigid board from the respective container during one stroke of the toothed rack.

3. The apparatus as claimed in claim 1, wherein said movable bottom of one of said bins is connected to the rear wall thereof by means of telescopically connected tubes so that the tubes of a greater diameter are located in this wall and the ends of the tubes of a smaller diameter are fixed to said movable bottom.

4. The apparatus as claimed in claim 1, wherein one of the bins is provided with a stopping means for the stack being collected, said stopping means being fixed to the rear wall of that bin.

5. The apparatus as claimed in claim 1, wherein two superposed closed-loop horizontal conveyors are provided at either side of said discharge conveyor, said conveyors having plates supporting the stack, the height of said plates being at least equal to the height of the stack being discharged.

* * * * *